US005451751A

United States Patent [19]

Takimoto et al.

[11] Patent Number: 5,451,751

[45] Date of Patent: Sep. 19, 1995

[54] HIGH-FREQUENCY HEATING APPARATUS WITH WAVE GUIDE SWITCHING MEANS AND SELECTIVE POWER SWITCHING MEANS FOR MAGNETRON

[75] Inventors: Hitoshi Takimoto; Koji Murakami; Tatsuya Nakagawa, all of Kanagawa, Japan

[73] Assignee: Kabushiki Kaisha Toshiba, Kawasaki, Japan

[21] Appl. No.: 6,310

[22] Filed: Jan. 22, 1993

[30] Foreign Application Priority Data

| | | | |
|---|---|---|---|
| Jan. 23, 1992 | [JP] | Japan | 4-009935 |
| Jun. 8, 1992 | [JP] | Japan | 4-147649 |
| Jun. 8, 1992 | [JP] | Japan | 4-147651 |
| Aug. 20, 1992 | [JP] | Japan | 4-221531 |

[51] Int. Cl.[6] ..... H05B 6/72; H05B 6/78

[52] U.S. Cl. ..... 219/746; 219/754; 219/687; 219/717

[58] Field of Search ..... 219/10.55 F, 10.55 E, 219/10.55 A, 10.55 B, 10.55 D, 746, 748, 750, 754, 755, 738, 741, 717, 697, 687

[56] References Cited

U.S. PATENT DOCUMENTS

| | | | |
|---|---|---|---|
| 2,909,635 | 10/1959 | Haagensen | 219/10.55 F |
| 3,810,248 | 5/1974 | Risman et al. | 219/10.55 |
| 4,458,126 | 7/1984 | Dills et al. | 219/10.55 F |
| 4,499,356 | 2/1985 | Hatagawa | 219/10.55 E |
| 4,501,944 | 2/1985 | Matsushima | 219/10.55 F |
| 4,591,682 | 5/1986 | Takeuji | 219/10.55 F |
| 4,800,246 | 1/1989 | Lee et al. | 219/10.55 D |
| 4,939,331 | 7/1990 | Berggren et al. | 219/10.55 B |
| 5,034,587 | 7/1991 | Takagi | 219/10.55 F |
| 5,155,317 | 10/1992 | Lee | 219/10.55 D |

FOREIGN PATENT DOCUMENTS

| | | |
|---|---|---|
| 0091779 | 10/1983 | European Pat. Off. . |
| 0373608 | 6/1990 | European Pat. Off. . |
| 2151655 | 4/1972 | Germany . |
| 52-49752 | 4/1977 | Japan . |
| 58-112298 | 7/1983 | Japan . |
| 58-188089 | 11/1983 | Japan . |

*Primary Examiner*—Philip H. Leung
*Attorney, Agent, or Firm*—Foley & Lardner

[57] ABSTRACT

A high-frequency heating apparatus capable of heating uniformly a liquid load, having an economical wave guide switching unit and having a compact-sized and economical power circuit to drive a plurality of magnetrons. The high-frequency heating apparatus includes an excitation opening, provided at the bottom of a heating chamber for radiating microwaves to heat the liquid load in a container, a magnetron for generating the microwave to heat the object and a wave guide connected to a magnetron. The apparatus further includes a wave guide switching unity for switching the propagation of the microwave to one of plural wave guides. The switching unit includes a pair of circular conductive plates and a conductor disposed in the vicinity of a circumference of the circular conductive plate so as to shut off the microwave, wherein there is constructed a choke structure on the wave guide containing the circular conductive plates. The apparatus further includes a magnetron drive circuit including a filament heating power supply connected to each filament of the magnetrons, a high voltage generating element and a switching element for selectively supplying a high voltage from the high voltage generating element to an anode of the magnetrons.

8 Claims, 13 Drawing Sheets

HIGH-FREQUENCY HEATING APPARATUS WITH WAVE GUIDE SWITCHING MEANS AND SELECTIVE POWER SWITCHING MEANS FOR MAGNETRON

BACKGROUND OF THE INVENTION

1. Field of the Invention

The present invention relates to a high-frequency heating apparatus for irradiating a microwave so as to perform dielectric heating, and it particularly relates to a microwave oven.

2. Description of the Prior Art

In a high-frequency heating apparatus, there is a method for heating to heat an object uniformly where the position of the object to be heated relative to a standing wave in a heating chamber is constantly change. Thus, a portion of the object to be heated thereby changes, so as to realize a uniform heating. For example, a stirrer fan is conventionally used for rotating a metal fan mounted on a ceiling, a side wall or a base so as to stir the microwave, a turntable method for heating the object while the object is being rotated, and a rotation antenna method for rotating an antenna which is a radiator of an electric wave.

FIG. 1 shows a high-frequency heating apparatus employing the turntable method. In the high-frequency heating apparatus shown in FIG. 1, there is provided at a side wall 3 a magnetron for generating the microwave, and the microwave thus generated from the magnetron is radiated from an excitation opening 9 provided at an upper portion of the side wall 3 into a heating chamber 1 through a wave guide 7. Then, the irradiated microwave reaches an object 13 placed on a rotating turntable 11, so as to heat the object.

In such a conventional high-frequency heating apparatus, the object 13 to be heated is rotated by the turntable 11. The microwave radiated from the above evenly irradiates the object 13, to realize a uniform heating. For solid and semi-solid objects, almost uniform heating can be obtained. However, in the case of a container filled with a liquid , there occurs a temperature difference between an upper portion and a lower portion therefor due to heat convection, so that there is heat unevenness in the liquid. For example, referring to FIG. 2, the temperature difference is significant in heating a sake in a sake bottle or a cup of milk or the like. This undesirable temperature difference occurs not only in the turntable method but also in the stirrer fan method as well as the rotating antenna method where in these methods the excitation opening for the microwave is provided in the upper portion of the heating chamber 1.

FIG. 3 shows a temperature rise at each point A through D when the sake bottle is filled with water and dielectric-heated. In the same figure, a rate of temperature rise in the upper portion of liquid is faster than that in the lower portion of liquid, thus causing a temperature difference therebetween to become greater as time lapses. For example, suppose that 40° C. is a proper temperature for heating sake. Then, by the time the lowest portion D of the sake bottle becomes a temperature of 40° C., there is a temperature difference of over 15° C. between D and the upper position A. At this stage, sake in a certain portion of the bottle presents a desirable temperature while other portion thereof does not.

Accordingly, there is a problem in the conventional high-frequency heating apparatus where a significant temperature difference is caused by a liquid load in heating the liquid.

In the high-frequency heating apparatus it has, in general, a single excitation opening. A wave guide switching device is not required for such the apparatus with a single excitation opening. Furthermore, even for a microwave oven having a plurality of excitation openings there is no wave guide switching device.

However, considering the various loads in a microwave oven, it would be more efficient if the excitation openings are switched according to each load, so as to achieve an optimum heating of the load.

Accordingly, the conventional microwave oven is not equipped with the wave guide switching device. Moreover, even if a usual wave guide switching device is implemented for the microwave oven, a cost increase, heavier weight thereof and a bulky size, result. These are not suitable for the microwave oven.

When various loads are heated by the microwave oven, it is desirable to have a plurality of magnetrons in order to achieve the optimum heating of the load. For example, FIG. 5 shows a microwave oven with which two magnetrons are equipped.

In a microwave oven having a plurality of magnetrons, there are conventionally provided separate power supplies for each magnetron in order to drive the magnetrons. Thus, each power supply is switched on and off separately in order to switch the excitation opening for each magnetron.

FIG. 4 shows a schematic diagram of a power supply portion which drives two magnetrons. The primary sides of the two magnetrons 51, 53 are connected to transformers 57, 59, which are, in turn, connected to an a.c. power supply 55. More specifically, an anode of the magnetron 51 is connected to a high-voltage secondary winding **57*a* through a voltage doubler rectifying circuit, and a filament of the magnetron 51 is directly connected to a filament-use secondary winding 57*b* of the transformer 57, thus a high voltage and a filament voltage being supplied thereto respectively. In the similar manner, an anode of the magnetron 53 is connected to a high-voltage secondary winding 59*a* through a voltage doubler rectifying circuit, and a filament of the magnetron 53 is directly connected to a filament-use secondary winding 59*b* of the transformer, thus a high voltage and a filament voltage being supplied respectively. Primary sides of the transformers 57, 59 for the magnetrons 51, 53 are respectively connected to the a.c. power supply 55 through switches 61, 63 so that the magnetrons 51, 53 are switched on and off by the switches 61, 63**, respectively.

However, in the above conventional microwave ovens, there are provided respective power circuits including transformers and rectifying circuits and-so on for each of the plural magnetrons, thus causing a problem of being not economical and of occupying a large space for mounting thereof.

SUMMARY OF THE INVENTION

The present invention has been made to overcome the foregoing drawbacks.

Therefore, the objects of the present invention are to provide a high-frequency heating apparatus capable of uniformly heating a liquid load; to provide an economical wave guide switching means for a high-frequency heating apparatus; and to provide a microwave oven where a plurality of magnetrons thereof are driven by a compact-sized and economical power circuit.

The first aspect of the present invention is to provide a high-frequency heating apparatus where a microwave is radiated into a heating chamber so as to heat an object therein, the apparatus comprising: an excitation opening, provided at the bottom of the heating chamber, for radiating the microwave to heat liquid load in a container; a turntable for rotating the object; a magnetron for generating the microwave to heat the object; and a wave guide connected to the magnetron and which is opened to the heating chamber through the excitation opening.

The second aspect of the present invention is to provide a high-frequency heating apparatus having two wave guides so that the microwaves are propagated into two different excitation openings, comprising: wave guide switching means for switching a propagation of the microwave to either of the two wave guides, the switching means including a pair of circular conductive plates and a conductor disposed in the vicinity of a circumference of the circular conductive plate so as to shut off the microwave, wherein there is a choke structure on the wave guide containing the circular conductive plates therein.

The third aspect of the present invention is to a high-frequency heating apparatus having a plurality of magnetrons, comprising a magnetron drive circuit comprising: a filament heating power supply connected to each filament of the magnetrons; means for generating a high voltage; and switching means for selectively supplying a high voltage from the high voltage generating means to an anode of the magnetrons.

Thereby, though respective filaments for a plurality of magnetrons are heated by a respective filament-heating power source, high voltage is selectively supplied to anode thereof by way of the switching means.

Other features and advantages of the present invention will become apparent from the following description taken in conjunction with the accompanying drawings.

DETAILED DESCRIPTION OF THE PREFERRED EMBODIMENTS

Features of the present invention will become apparent in the course of the following description of exemplary embodiments which are given for illustration of the invention and are not intended to be limiting thereof. Embodiments of the present invention will now be described with reference to the drawings.

Figure 5:
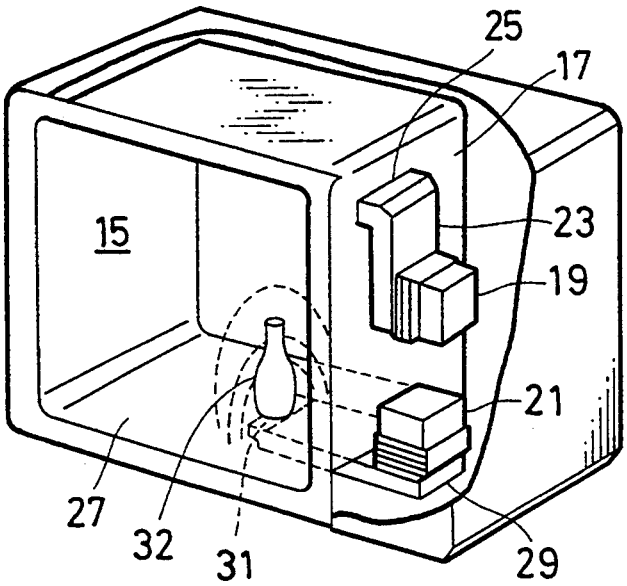
FIG. 5 shows an internal view of a microwave oven as a high-frequency heating apparatus, without a turntable.

FIG. 5 shows an internal view of a microwave oven as a high-frequency heating apparatus, where a turntable (not shown) is removed. The microwave oven is equipped with two magnetrons 19, 21 for generating a microwaves at external portions of a side wall 17 of a heating chamber 15. The upper magnetron 19 is connected to a wave guide 23 along the side wall 17. An excitation opening 25 is provided at an upper end of the wave guide 23, situated in an upper portion of the side wall 17 and opened to the heating chamber 15. The microwaves radiated from the excitation opening 25 are used to heat a solid or semi-solid body placed on the turntable.

The lower magnetron 21 is connected to a wave guide 29 along a base 27 of the heating chamber 15, and an excitation opening 31 formed at an end of the wave guide 29 is situated in the vicinity of a center of the base 27 and opened to the heating chamber 15. The microwave radiated from the excitation opening 31 is used for heating a liquid in a liquid container, such as a sake bottle 32.

Figure 6:
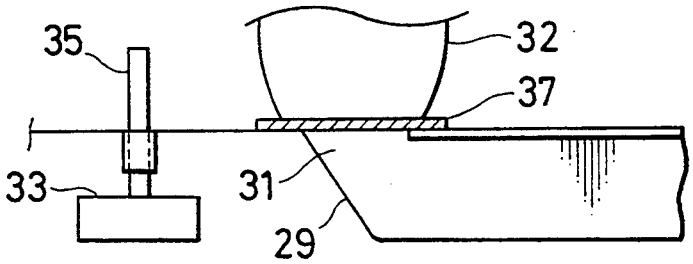
FIG. 6 shows an enlarged cross section in the neighborhood of the excitation opening 31 which is exclusively used for heating the liquid.

FIG. 6 shows a enlarged cross section in the neighborhood of the excitation opening 31 which is exclusively used for heating the liquid. When heating a solid or semi-solid body, the turntable (not shown) is mounted on a shaft 35 of a RT motor 33. When heating the liquid contained in a container, the turntable is removed and a waterproof insulating plate 37 permeated by the microwave is placed so that a sake bottle 32 containing a sake to be heated is placed thereupon.

When heating the liquid, a key on a display panel designating a liquid load heating is depressed while the sake bottle 32 is kept at a position illustrated in FIG. 6. Then, the microwave is generated from the magnetron 21 whereas no microwave is generated from the magnetron 19. Thereby, the microwave at the bottom of the sake bottle 32 is gradually absorbed by a base portion of the sake bottle 32 so that convection heat is caused in the sake bottle 32, to uniformly heat the liquid load therein.

Figure 1:
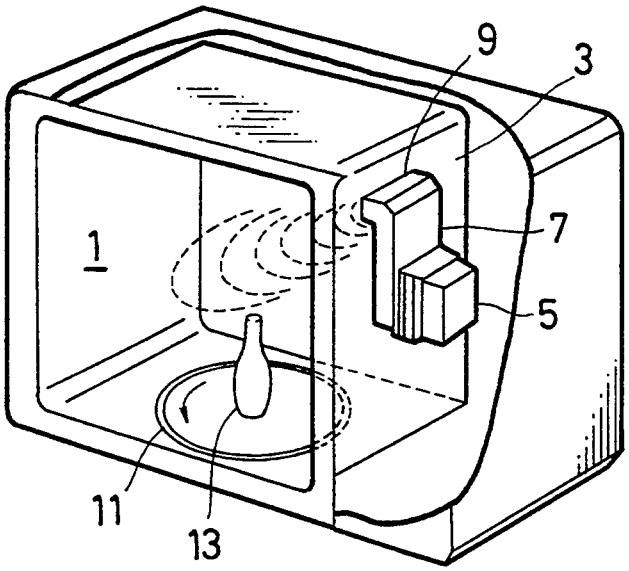
FIG. 1 PRIOR ART
FIG. 1 shows a conventional high-frequency heating apparatus employing the turntable method.
Figure 2:
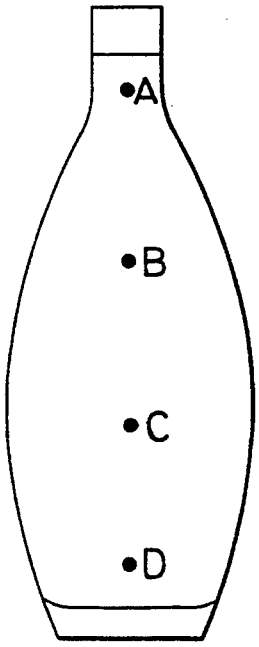
FIG. 2 shows a sake bottle where there are labeled A, B, C and D for measuring the temperature of liquid inside the sake bottle.
Figure 3:
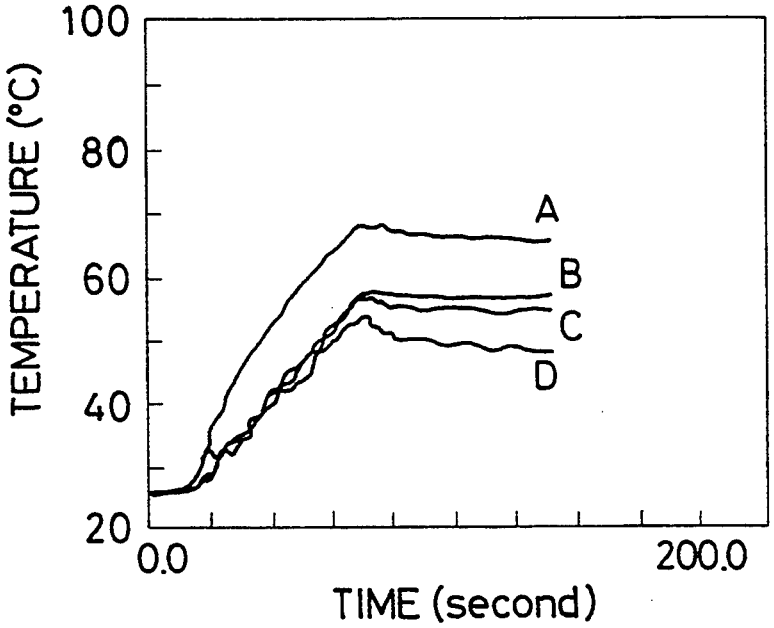
FIG. 3 PRIOR ART
FIG. 3 shows a temperature rise at each point A through D when the sake bottle is filled with water and dielectric-heated.
Figure 4:
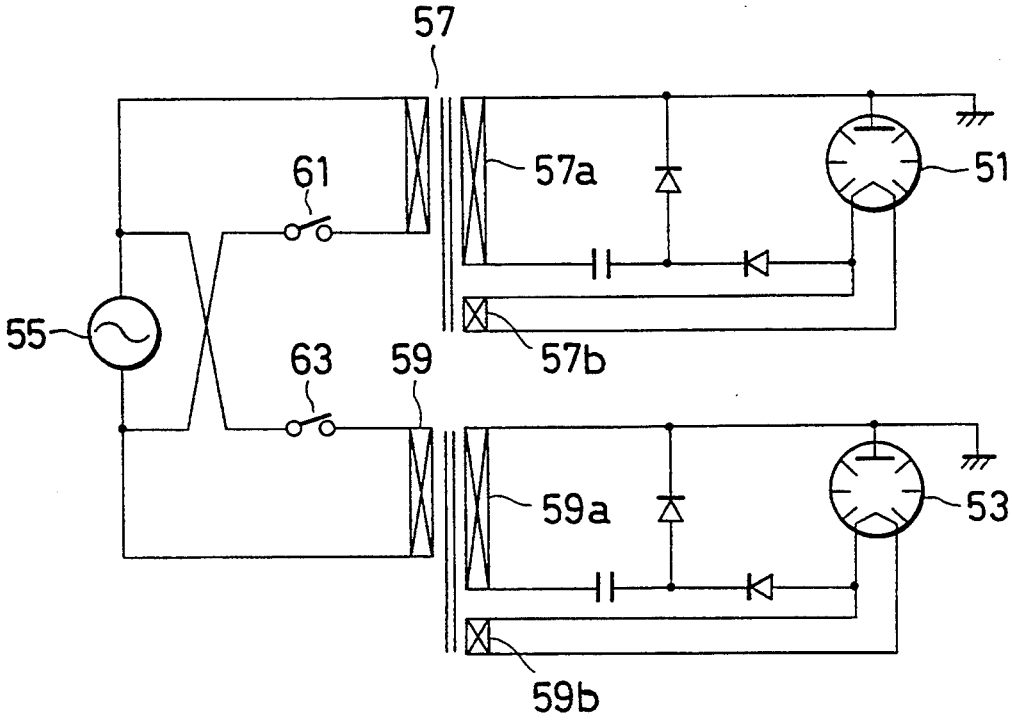
FIG. 4 PRIOR ART
FIG. 4 shows a schematic diagram of a power supply portion which drives two magnetrons.
Figure 7:
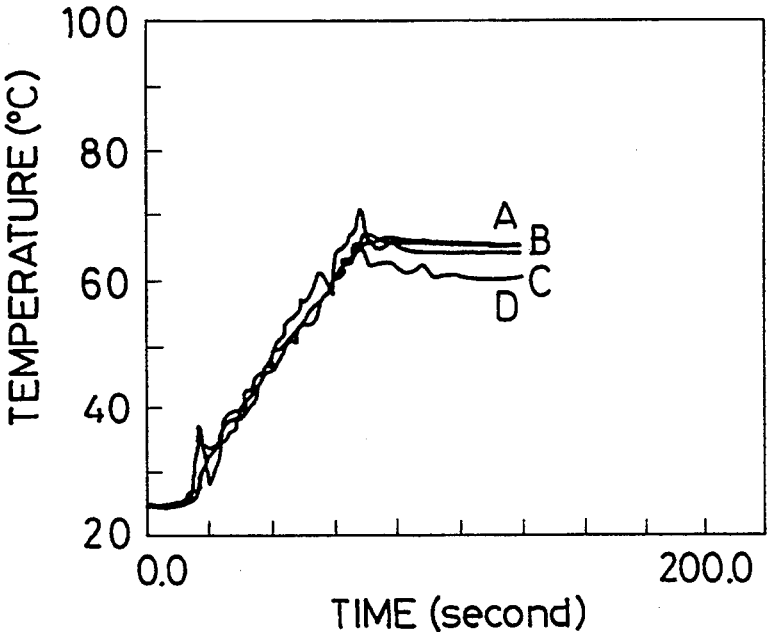
FIG. 7 shows a change in temperature according to this embodiment, where respective temperatures are measured at points A through D (refer to FIG. 2).

FIG. 7 a change in temperature according to this embodiment, where respective temperatures are measured at points A through D (refer to FIG. 2). In the same figure, the temperature at respective points rise at a same rate, so that even heating is achieved.

Figure 8:
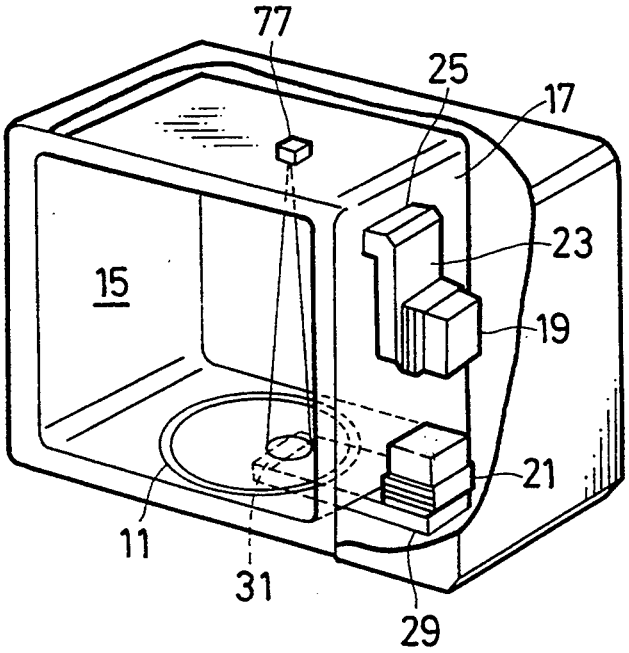
FIG. 8 shows a high-frequency heating apparatus where the sake bottle is placed on the turntable 11 so that the liquid inside the sake bottle can be evenly heated without removing the turntable 11.

FIG. 8 shows a high-frequency heating apparatus where the sake bottle is placed on the turntable 11 so that the liquid inside the sake bottle can be evenly heated without removing the turntable 11.

Referring to FIG. 16 and FIGS. 11 through 14, it is explained how a distance between the excitation opening 31 for exclusive use for heating liquid and the base 32 affects absorption of The microwave.

Referring to FIG. 7 and FIGS. 11 through 14, the distance between a liquid container 32 and the excitation opening 31 are changed in a range of 0 mm to 30 mm.

The temperature difference between A and D increases as The temperature rises. When the distances are 0 mm, 9 mm and 18 mm, the temperature difference between A and D is relatively small, whereas when the distances are 24 mm and 30 mm, the temperature difference between A and D becomes significantly large.

In order to obtain sufficient heating, The distance is preferably made smaller than 18 mm. Furthermore, in order to keep the temperature difference at a minimum under other conditions, such as a different type of liquid container and an initial liquid temperature, the distance is preferably less than $\frac{1}{8}$ wavelength (15 mm).

Observing the above results where There can be considered a configuration in which the turntable is movable in a vertical direction, The present invention offers The following embodiment.

Figure 9:
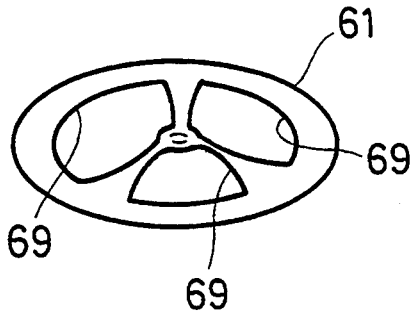
FIG. 9 shows a perspective view of a turntable support having three openings.
Figure 10:
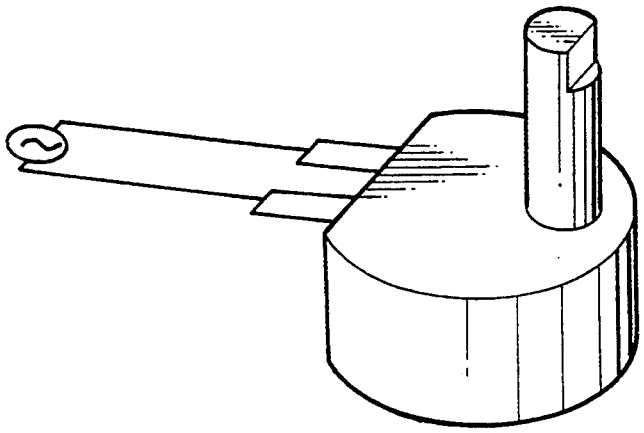
FIG. 10 shows a perspective view of of a motor.
Figure 11:
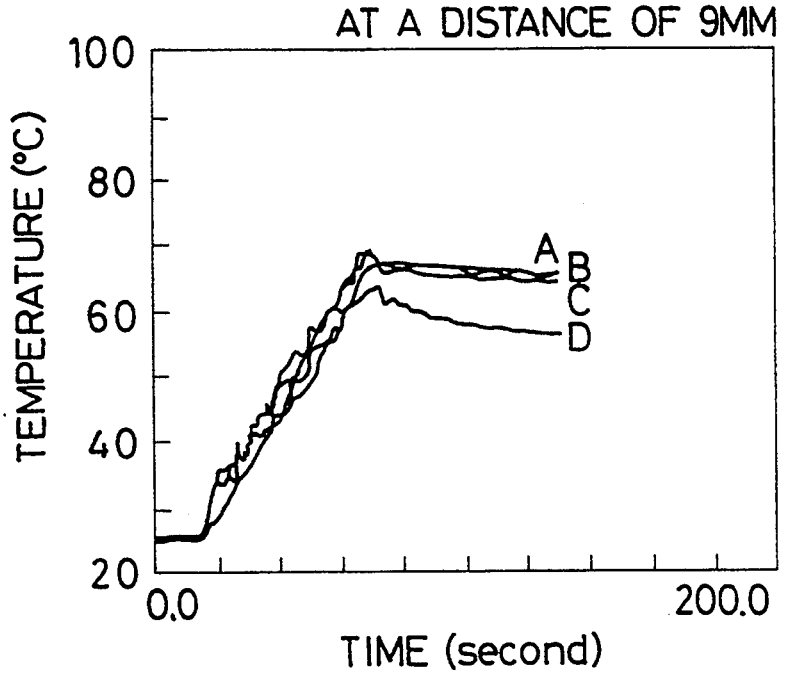
FIGS. 11 through 14 show respective temperature distribution when vertical distances between the excitation opening 31 and the base 32 are 9 mm, 18 mm, 24 mm and 30 mm, respectively.
Figure 12:
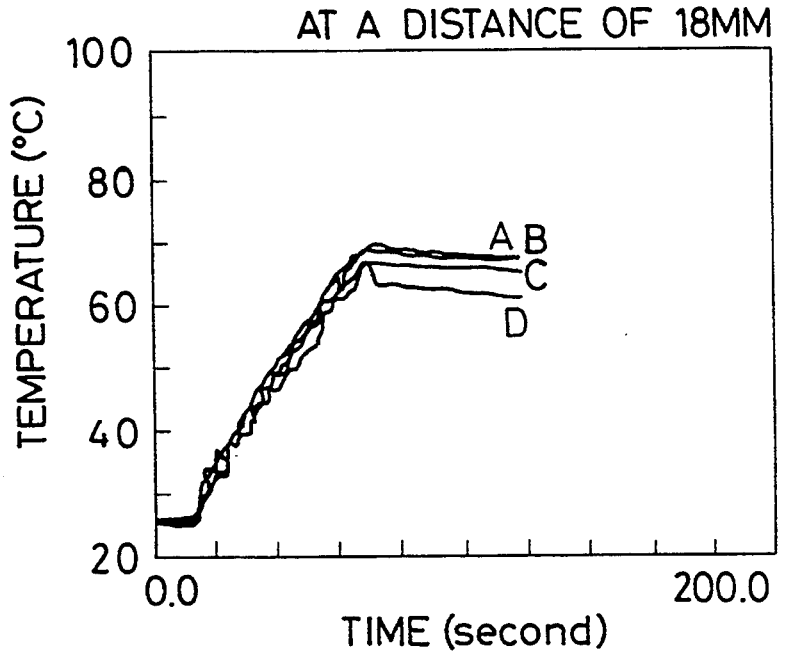
Figure 13:
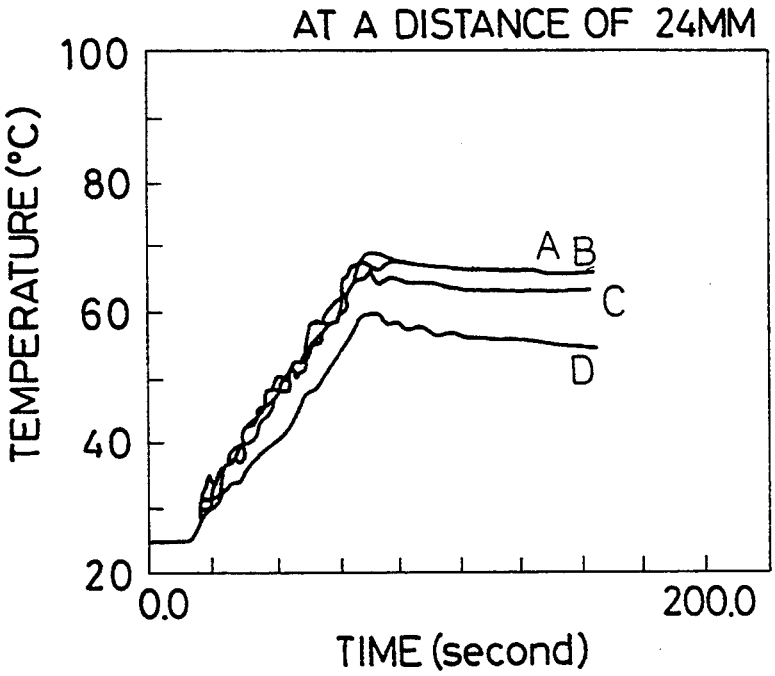
Figure 14:
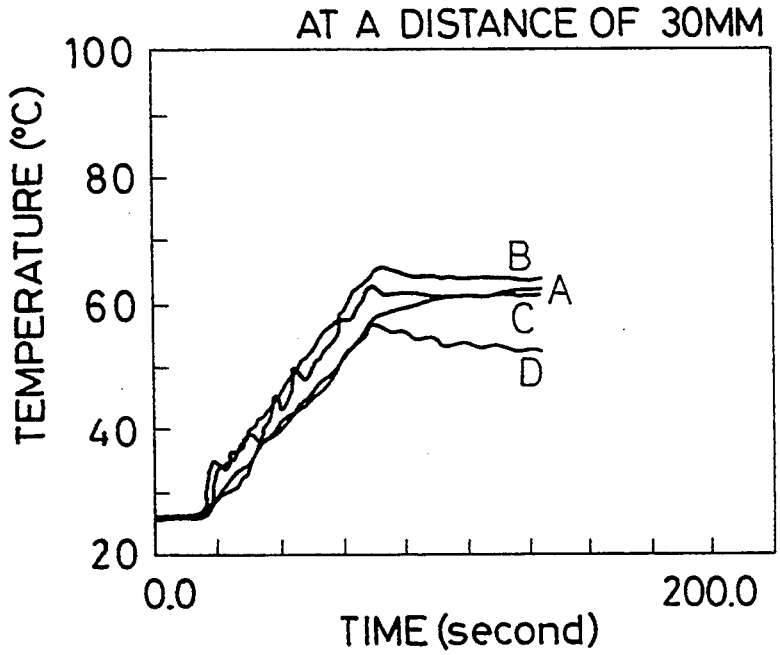

With reference to FIG. 9 and FIG. 10, there are provided three protruding members 67 (FIG. 16) equidistanced around the shaft 35 of the RT motor. A turntable support 61 has three openings 69 corresponding to the three protruded members 67. Referring to FIG. 10, there is a dap in the top end portion in The shaft 35. The dap is mounted to the turntable 11 so that the three protruded members 67 are coupled to respective centers of the openings 69 in a predetermined manner.

Figure 15:
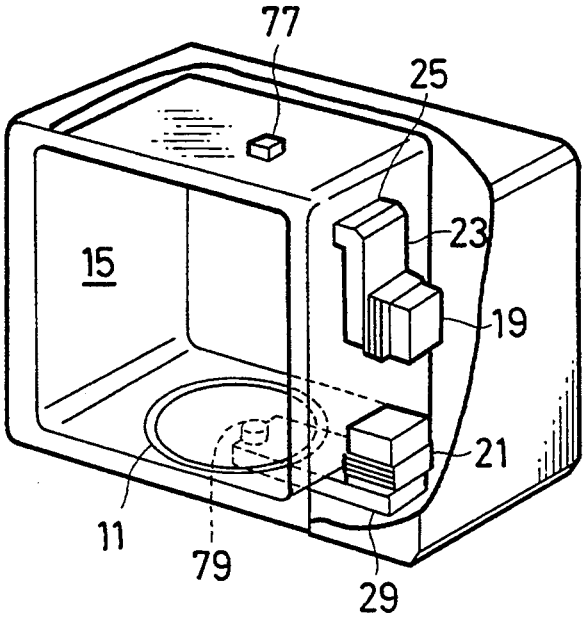
FIG. 15 shows a high-frequency heating apparatus in the second embodiment.
Figure 16:
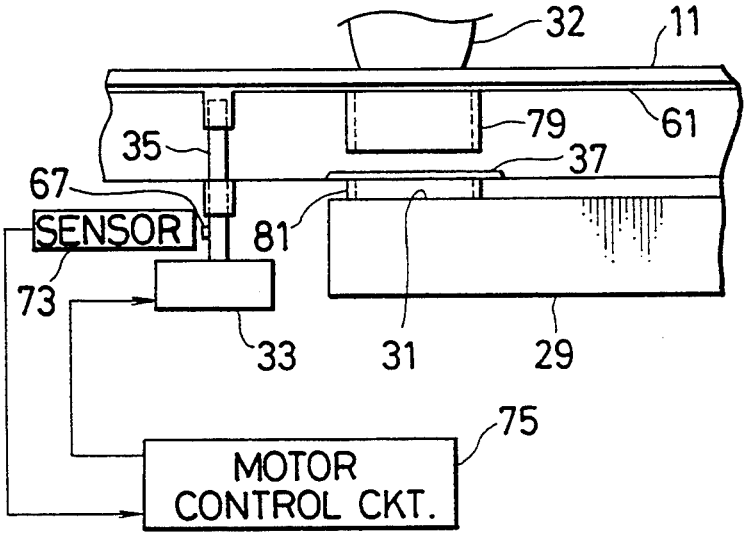
FIG. 16 shows an enlarged cross sectional view of a base portion at a bottom of the heating chamber shown in FIG. 15.
Figure 17:
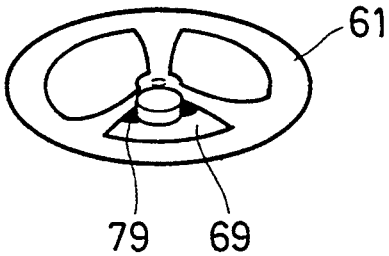
FIG. 17 shows a perspective view of the turntable support shown in FIG. 16.

FIGS. 15 through 17 show the second embodiment of the present invention.

With reference to FIG. 16, there is provided a cylindrical shape metal sleeve 79 under one of the openings 69 of the turntable support 61. There is also provided a protrusion 67 around the RT motor shaft 35 corresponding to the one of the opening 69 to which the cylindrical shape metal 79 is coupled. Further, there is provided above the excitation opening 31 of the wave guide 29 a cylindrical duct 81 having a same diameter with the cylindrical shape metal sleeve 79. A detection signal of a sensor 73, upon detecting the protrusion 67 is inputted to a motor control circuit 75. When the protrusion 67 is detected by the sensor 73, the motor control circuit 75 controls the RT motor 33 such that the cylindrical shape metal sleeve 79 mounted to the turntable support 61 is always disposed properly under the excitation opening 31 for exclusively heating the liquid load. It shall be appreciated that there can be mounted a plurality of the cylindrical shape metal sleeves 79 corresponding to the number of the openings 69.

By the above configuration, when the sake bottle is placed on a designated load area indicated by a spot light irradiated from a flood lamp 77 and a key on the display panel for exclusively heating the liquid load is depressed, the microwave is propagated into the cylindrical shape metal 79 from the liquid-heating excitation opening 31 through the wave guide 29. Then, since the microwave is confined inside the cylindrical shape metal sleeve 79, a significantly effective absorption of the microwave at the bottom of the sake bottle is achieved. Moreover, the turntable need not be removed, thus being more convenient compared to the first embodiment.

Figure 18A:
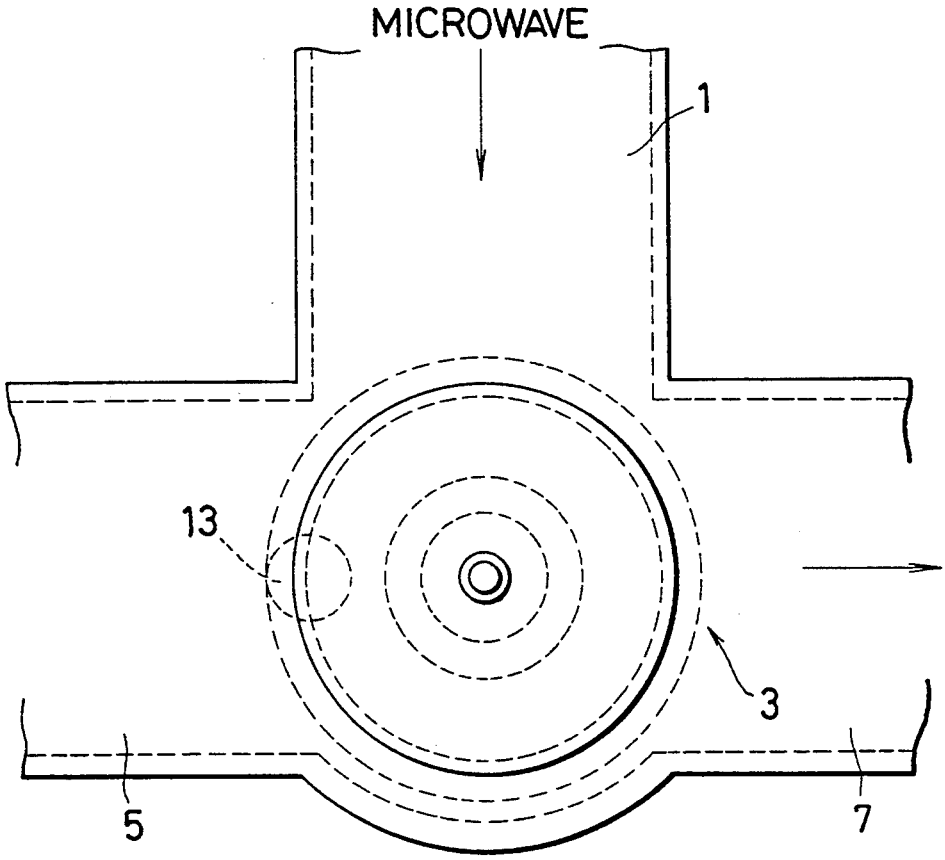
FIG. 18A and FIG. 18B show a plan view and a cross section of wave guide switching means for the high-frequency heating apparatus.
Figure 18B:
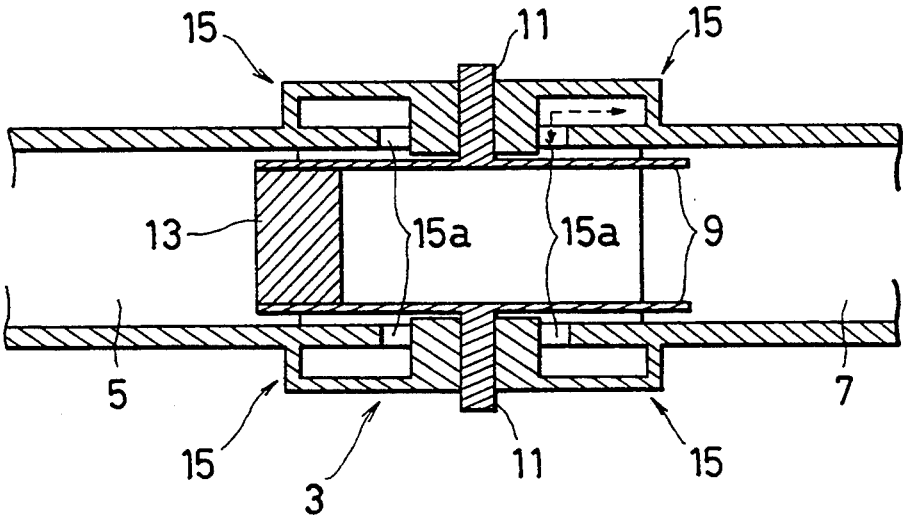
Figure 19:
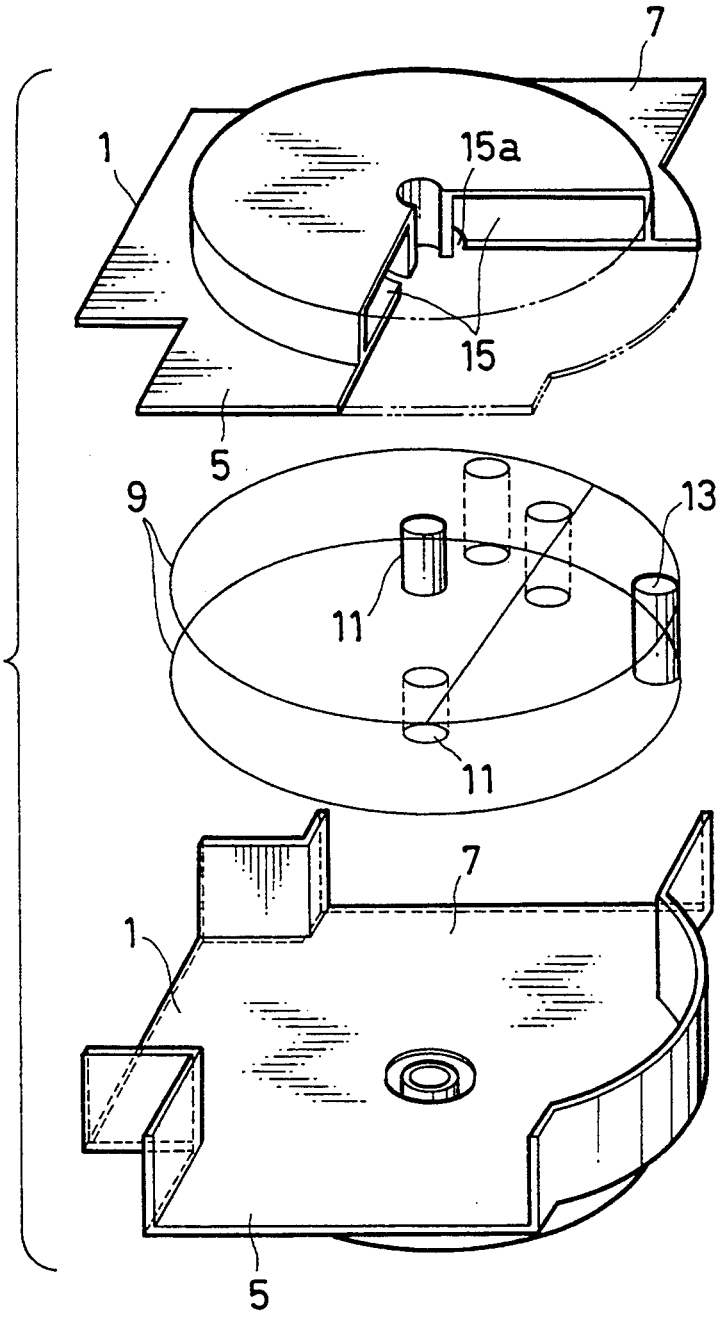
FIG. 19 shows a perspective and disassembling view of the wave guide switching means shown in FIG. 18.
Figure 24:
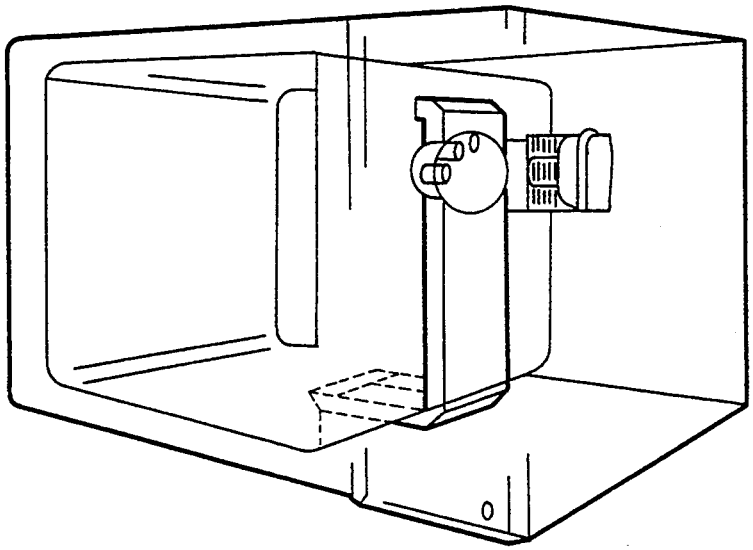
FIG. 24 shows a microwave oven employing the wave guide switching means shown in FIG. 20. In the same figure, there are two excitation openings and the microwave is selectively supplied by the wave guide switching means shown in FIG. 20.

Accordingly, the microwave is irradiated to the heating chamber from the excitation opening provided at the bottom of the heating chamber, so that the liquid load placed in the vicinity of the excitation opening can be evenly heated by a heat convection from the bottom thereof. Next, the present invention concerns a wave guide switching means where there are two wave guides extending from and connecting to a magnetron as illustrated in FIG. 24. FIG. 18A and FIG. 18B show a plan view and a cross section of wave guide switching means for the high-frequency heating apparatus. FIG. 19 shows a perspective and disassembling view of the wave guide switching means shown in FIG. 18.

With reference to FIG. 18, a rectangular wave guide 1 extending upward is connected to the magnetron (not shown) and the microwave is propagated into the wave guide 1. A lower end of the wave guide 1 is coupled to other wave guides 5, 7 in a T-shape form by way of a wave guide switching unit 3. The microwave propagated through the wave guide 1 propagates to either the left side wave guide 5 or the right side wave guide 7 by means of the wave guide switching unit 3.

With reference to FIG. 18B, in the wave guide switching unit 3, a pair of circular conductive plates 9 are provided in parallel to an H-plane which contacts the long side of the cross section of the wave guide 1. The pair of the conductive plates 9 are coupled to a pair of shafts 11 so as to rotate about the shaft 11.

Referring again to FIG. 18B, there is provided a first cylindrical shape conductor 13 between the pair of the circular conductive plates 9, so that the conductor 13 can rotate to any position along with rotation of the circular conducting plates 9. When the conductor 13 is placed in a position as illustrated in FIG. 18B and FIG. 15, the microwave is shielded from the wave guide 1. As a result, the microwave from the wave guide 1 is propagated only into the wave guide 7 by way of the wave guide switching unit 3.

Moreover, there is provide a choke structure 15 in a space of the H-plane of the wave guide as illustrated in FIG. 18B. The H-plane constituting a part of the choke structure 15 has openings 15*a*. The openings 15*a* are points where a voltage of the standing wave is maximum, so that there is no leakage of the microwave from a space between the openings 15*a* and the shaft 11. The distance between the opening 15*a* and end of the choke structure is preferably approximately $\lambda/4$ to $\lambda g/4$ (illustrated with combined dotted arrows in FIG. 18B)

Moreover, the distance between the opening 15 and an end of the circumference of the circular conductive plate 9 is preferably approximately λ/4 to λg/4, so that the end portion of the circumference of the circular conductive plate 9 becomes a short-circuit point and there can be maintained an electric connection with the H-plane of the wave guide. Accordingly, by taking dimensions of approximately λ/4 to λg/4, there can be achieved the optimum choke structure. Here, λg indicates a wavelength inside the wave guide whereas λ indicates a wavelength in a normal space, and relation therebetween is such that λg≧λ.

In the wave guide switching unit thus configured, the circular conductive plate 9 is electrically connected to the H-plane, namely, the both ends of the first conductor 13 are connected to the H-plane, so that the wave guide 5 is shut off and the microwave is propagated into the other wave guide 7.

Figure 20A:
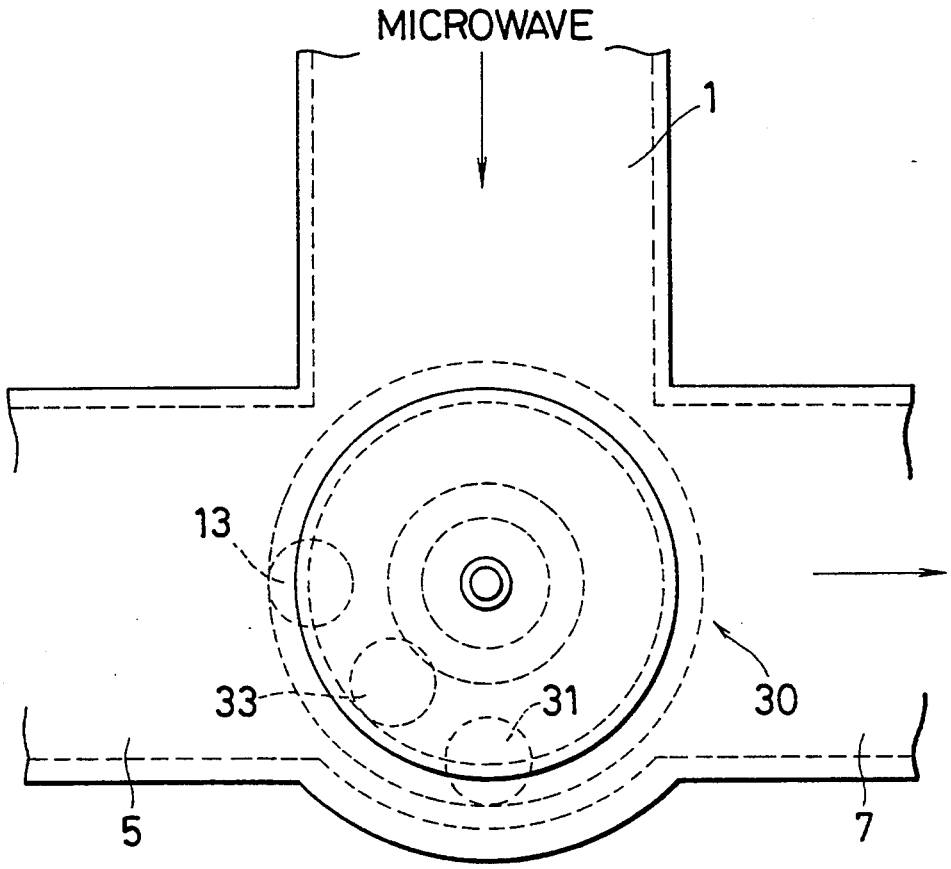
FIG. 20A and FIG. 20B shows another wave guide switching means of another embodiment and a cross section thereof, respectively.
Figure 20B:
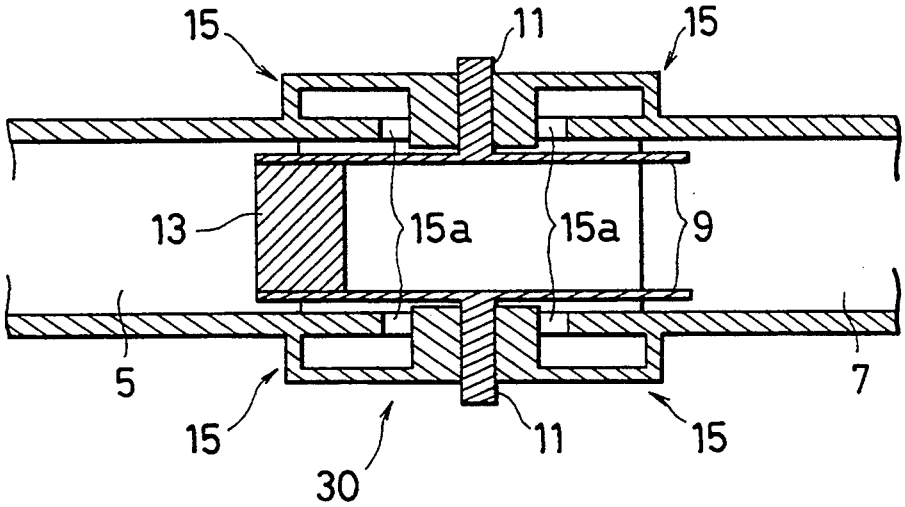

FIG. 20A and FIG. 20B shows another wave guide switching means of another embodiment and a cross section thereof, respectively. Compared to the wave guide switching means shown in FIG. 18, there are provided a second conductor 31 90 degrees from the first conductor 13 and a third conductor 33 between the first conductor 13 and the second conductor 31.

By providing the first, second and third conductors 13, 33, 31, there is formed a pseudo wave guide surface, moreover, the three conductors form a sort of fairing to cover a rotating bulge portion on the circular conductive plates 9. In other words, an electric geometry due to the bulge portion is smoothed up.

FIG. 24 shows a microwave oven employing the wave guide switching means shown in FIG. 20. In the same figure, there are two excitation openings and the microwave is selectively supplied by the wave guide switching means shown in FIG. 20.

Figure 21:
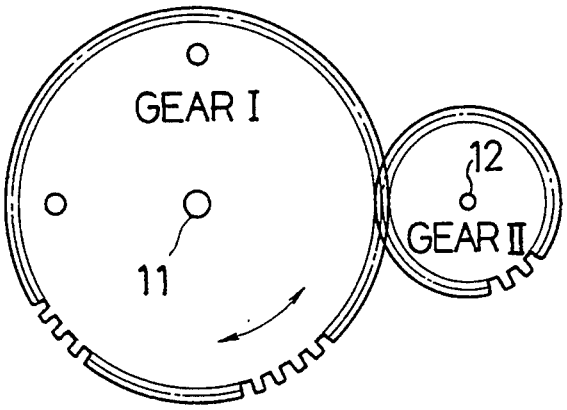
FIGS. 21 through 23 show a drive mechanism for driving the wave guide switching means.
Figure 22:
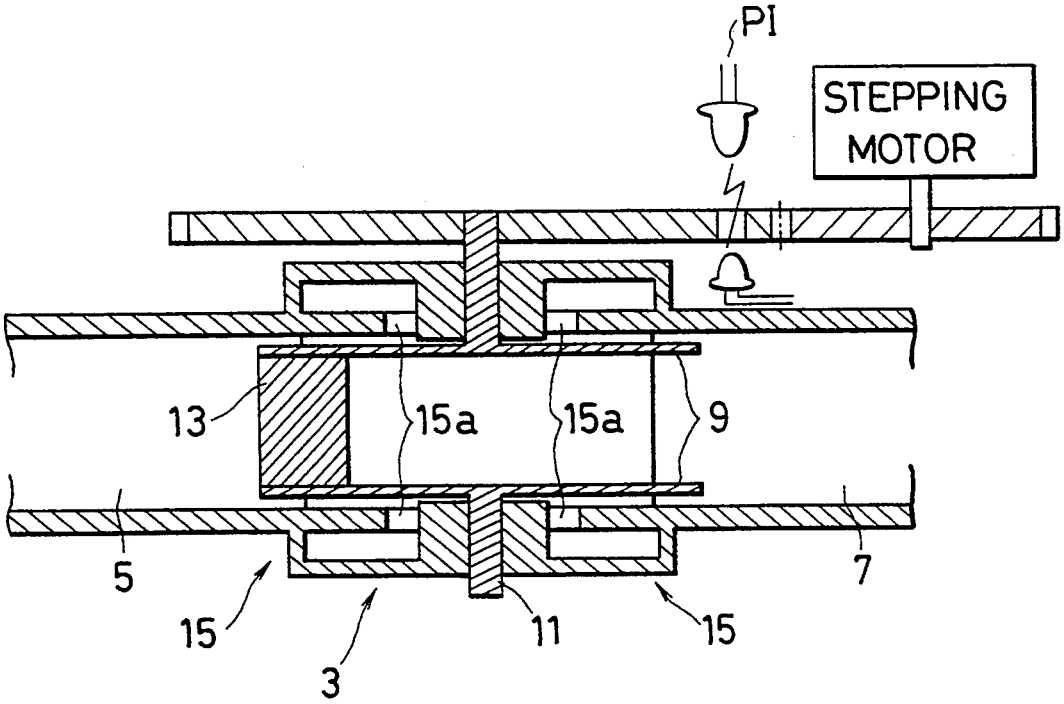
Figure 23:
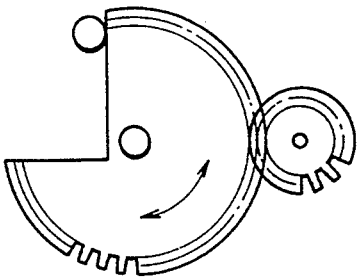

With reference to FIGS. 21 through 23, an example of a drive mechanism for the wave guide switching unit 3 will be described.

Referring to FIG. 21, a first circular gear (GEAR I) is coupled to the rotation shaft 11 outside the switching unit 3, and the GEAR I is driven by a stepping motor by way of a second gear (GEAR II) coupled to a rotation shaft 12. Two holes are provided in the first gear in near circumference thereof so that the holes are detected by a photo interrupter (PI) (refer FIG. 22) and the conductor 13 is positioned at a predetermined position. A reason for using the stepping motor is because it has a stationary torque so that even if it is not electrically driven the gear remains stable. It shall be appreciated that a DC motor may replace the stepping motor and there can be provided a stopper as illustrated in FIG. 23. Thus two alternative positions can be obtained by switching a direction to drive the motor, so as to stabilize the movement of the gears.

Accordingly, by implementing the above wave guide means where there is provided the first conductor between the a pair of conductive plates which are freely rotatable, one of two wave guides can be shut off by positioning the first conductor in front of a given wave guide, thus providing a simply built and economical wave guide switching unit. Moreover, since the both ends of the conductor are electrically joined to the wall of the wave guide, there is no arc discharge. Moreover, by providing a plurality of conductors, a voltage standing wave ratio (VSWR) of the wave guide can be suppressed to the minimum.

Figure 25:
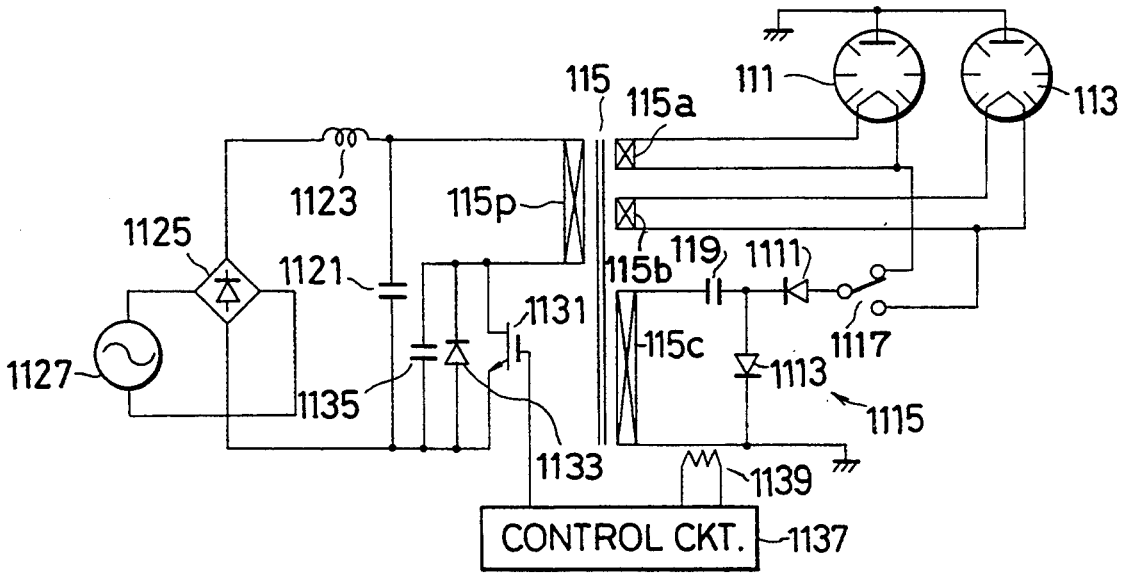
FIG. 25 shows a drive circuit for a microwave oven according to the present invention.

Next, FIG. 25 shows a drive circuit for a microwave oven according to the present invention With reference to FIG. 25, filaments for magnetrons 111, 113 are connected to filament-use secondary windings 115*a*, 115*b* of a transformer 115, respectively, and a filament-use voltage is supplied from the secondary windings 115*a*, 115*b* so as to generate heat. Anodes of the magnetrons 111, 113 are grounded. An end for each filament is connected to high-voltage secondary winding 115*c* by way of a voltage doubler rectifying circuit 115 constituted by a switch 117, diodes 111, 113, and capacitor 119, thereby the high voltage from the secondary winding 115*c* and the increased voltage doubled by the voltage doubler rectifying circuit 115 are selectively supplied to anodes of the magnetron 111, 113 by means of the switch 117.

The primary winding 115*p* is connected to an a.c. power supply by way of a smoothing capacitor 1121, a choke 1123 and a rectifying circuit 1125. A parallel circuit comprising a transistor 1131, a diode 1131 and a capacitor 1135 is connected between the primary winding 115*p* of the transformer 115 and the smoothing capacitor 1121, wherein the transistor 1131 is controlled by a control circuit 1137. The control circuit 1137 is such that a current at a secondary side of the transformer 115 is detected through a converter 1139. The control circuit 1137, the transistor 1131, the diode 1133, the capacitor 1135 and the converter 1139 detect an output voltage at a secondary side of the transformer 115 and constitute together with the transformer 115 an inverter circuit in which the input voltage is converted and controlled to a predetermined a.c. voltage.

In the magnetron drive circuit thus configured, the a.c. voltage from the a.c. power supply 1127 is rectified by a diode bridge rectifying circuit 1125 and is then smoothed by the choke 1123 and the smoothing capacitor 1121, thereafter converted to a predetermined a.c. voltage by the inverter circuit comprising the control circuit 1137 and so on and then supplied to the primary winding 115*p* of the transformer 115 so that a predetermined secondary voltage is supplied to each secondary winding.

Thereafter, the filament voltages from the filament-use secondary winding 115*a*, 115*b* of the transformer 115 are simultaneously supplied to filaments of the magnetrons 111, 113 so that both filaments of the both magnetrons 111, 113 are simultaneously heated.

When the switch is connected as illustrated in FIG. 25, the high voltage from the secondary winding 115*c* of the transformer 115 is voltage-doubler-rectified by the voltage doubler rectifying circuit 1115 and then an end of the Filament of the magnetron 111 by way of the switch 117 so that a high voltage is supplied to the anode of the magnetron connected between the end of the filament and the ground so as to drive the magnetron 111.

When the switch is connected to a opposite side to the above case, the high voltage from the secondary winding 115*c* of the transformer 115 is supplied to a side of the magnetron 113 so that the magnetron 113 is driven then.

As the switch 117, a switch of make-before-break (MBB) type may be preferably use for there will not be generated an abnormal high voltage at the time of switching.

Accordingly, though each filament of plural magnetrons are heated by each filament heating power supply, high voltage is selectively supplied to the anode thereof by means of the switching means. Therefore, there will be no need to provide separate drive power to each magnetron as in the conventional practice. Thus, the present invention provides a microwave oven which is economical and space-conserved. Moreover, since the filaments are driven constantly, an operational speed for a magnetron at the time of selectively switching the high voltage is made significantly faster.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A high-frequency heating apparatus in which microwaves are radiated into a heating chamber, so as to heat an object therein the heating apparatus comprising:

an excitation opening at a bottom of the heating chamber, for radiating the microwaves to heat the object, said object being only in the form of a liquid contained in a container;

a magnetron for generating the microwaves to heat the object;

a wave guide connected to the magnetron and open to the heating chamber through the excitation opening;

a turntable for rotating the object; and a cylindrical metal sleeve, provided between the excitation opening and the turntable, for spatially concentrating and directing the microwaves to the bottom of the heating chamber.

2. The apparatus of claim 1, further comprising:

a turntable support under the turntable;

a motor;

a shaft driven by the motor and connected to the turntable for rotating the turntable;

a protruding member attached to the shaft;

a control circuit for controlling the motor; and a sensor for detecting the protruding member attached to the shaft;

wherein the cylindrical metal sleeve is mounted over an opening in the turntable supports, and wherein the protruding member is detected by the sensor, the motor control circuit controlling the motor such that the cylindrical metal sleeve mounted over the turntable support is disposed properly under the excitation opening.

3. A high-frequency heating apparatus in Which microwaves are radiated into a heating chamber, so as to heat an object therein, the heating apparatus comprising:

a first excitation opening at a bottom of the heating chamber, for radiating the microwaves to heat the object, said object being only in the form of a liquid contained in a container;

a magnetron for generating the microwaves to heat the object;

a first wave guide open to the heating chamber through the first excitation opening;

a second wave guide and a second excitation opening, said second excitation opening being located on a side of the heating chamber so that microwaves are propagated into the first and second excitation openings;

wave guide switching means for switching the propagation of microwaves to either of the first and second wave guides, the switching means including a pair of circular conductive plates and a conductor disposed in the vicinity of a circumference of the circular conductive plates; and a choke on the wave guide switching means containing the circular conductive plates.

4. The apparatus of claim 3, wherein the thickness of the choke structure is approximately one-quarter wavelength, and the distance between the lower end of the choke and the circular conductive plate is approximately one-quarter wavelength.

5. The apparatus of claim 3 further including a plurality of conductors

6. The apparatus of claim 3 further including a first microwave conductor disposed in the vicinity of the circumference of the circular conductive body, a second microwave conductor disposed 90 degrees from the first conductor and a third conductor disposed therebetween.

7. The apparatus of claim 6, further comprising:

drive means for rotating the circular conductive plates;

wherein there are provided a first gear coupled to a rotation shaft connected to the circular conductive plate, and a second gear interlocked with the first gear and driven by a motor and wherein the first gear has a hole therein so that the conductor can be positioned to a predetermined position by means of sensing means disposed around the gear.

8. The apparatus of claim 7, wherein the first gear is driven in both directions and the position of the first gear is controlled by a stopper.

* * * * *